US010150648B2

(12) United States Patent
Shen

(10) Patent No.: US 10,150,648 B2
(45) Date of Patent: Dec. 11, 2018

(54) TIE-DOWN DEVICE FOR COMPENSATION SHEAVE, COMPENSATION SHEAVE AND ELEVATOR

(71) Applicant: Otis Elevator Company, Farmington, CT (US)

(72) Inventor: Yunzhu Shen, Shanghai (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/680,508

(22) Filed: Aug. 18, 2017

(65) Prior Publication Data

US 2018/0050884 A1 Feb. 22, 2018

(30) Foreign Application Priority Data

Aug. 18, 2016 (CN) ..... 2016 1 0683000

(51) Int. Cl.
*B66B 7/06* (2006.01)
*B66B 15/02* (2006.01)

(52) U.S. Cl.
CPC ..... *B66B 7/068* (2013.01); *B66B 15/02* (2013.01)

(58) Field of Classification Search
CPC ..... B66B 7/068; B66B 15/02; B66B 7/10
See application file for complete search history.

(56) References Cited

U.S. PATENT DOCUMENTS 1,641,957 A * 9/1927 Bledsoe ..... B66B 5/04 187/348
1,789,008 A * 1/1931 Lindquist ..... B66B 7/068 187/265

(Continued)

FOREIGN PATENT DOCUMENTS

DE 1295150 B 5/1969
JP S61211286 A 9/1986

(Continued)

OTHER PUBLICATIONS

European Search Report for application EP 17186949.8, dated Jan. 23, 2018, 9 pages.

(Continued)

*Primary Examiner* — Michael A Riegelman
(74) *Attorney, Agent, or Firm* — Cantor Colburn LLP

(57) ABSTRACT

A tensioning device for a compensating sheave. The compensating sheave is provided with a housing. The tensioning device comprises: a first snap-fit member; a second snap-fit member; and a trigger mechanism comprising a resilient assembly and a limiting assembly, wherein the limiting assembly is provided with a limiting member, wherein the tensioning device has a first state in which the limiting member abuts against a second end of the first snap-fit member so that a certain clearance is kept between a first end of the first snap-fit member and the second snap-fit member and a second state in which the limiting assembly is moved downward so that the first end of the first snap-fit member is rotated downward until the first end is snap-fitted with the second snap-fit member. A compensating sheave is provided with the above-described tensioning device and an elevator is configured with the above-described compensating sheave.

20 Claims, 4 Drawing Sheets

(56) References Cited

U.S. PATENT DOCUMENTS 1,944,772 A * 1/1934 White ..... B66B 7/068 187/265
1,953,119 A * 4/1934 McCormick ..... B66B 7/068 187/265
1,976,494 A * 10/1934 Halfvarson ..... B66B 7/068 187/264
2,270,441 A * 1/1942 Hymans ..... B66B 7/068 187/264
2,295,381 A * 9/1942 Bouton ..... B66B 7/068 187/264
3,012,634 A * 12/1961 Stelzer ..... B66B 9/08 187/201
3,174,585 A * 3/1965 Tofanelli ..... B66B 11/009 187/264
3,653,467 A * 4/1972 Showalter ..... B66B 7/068 187/265
5,277,276 A * 1/1994 Pramanik ..... B66B 7/068 187/411
5,509,503 A 4/1996 Salmon
5,513,760 A * 5/1996 Luebke ..... B66B 5/04 187/375
5,713,434 A * 2/1998 Sun ..... B66B 5/16 187/360
6,431,321 B2 * 8/2002 Ach ..... B66B 7/06 187/264
6,698,723 B1 * 3/2004 Antonini ..... B60P 7/083 254/391
7,753,176 B2 * 7/2010 Kigawa ..... B66B 5/06 187/280
7,946,390 B2 * 5/2011 McNamara ..... B66B 7/10 187/264
8,528,703 B2 * 9/2013 Husmann ..... B66B 7/10 187/249
9,038,781 B2 * 5/2015 Mustalahti ..... B66B 11/043 187/254
9,409,749 B2 * 8/2016 Kalliomaki ..... B66B 7/068
9,957,133 B2 * 5/2018 Shiraishi ..... B66B 5/04
2015/0291396 A1 * 10/2015 Nakamura ..... B66B 17/12 187/404
2015/0298939 A1 * 10/2015 Lampinen ..... B66B 7/068 187/265
2017/0022030 A1 * 1/2017 Bai ..... B66B 7/068
2018/0002141 A1 * 1/2018 Virta ..... B66B 7/02
2018/0029831 A1 * 2/2018 Renvall ..... B66B 15/02

FOREIGN PATENT DOCUMENTS

JP H11228055 A 8/1999
JP 2000118913 A 4/2000
KR 20040029816 A 4/2004
WO 2011051982 A1 5/2011

OTHER PUBLICATIONS

Bob Desnoyers Elevator & Escalator Inspections, Inc., "Update #19 Top of Car Clearances—Counterweighted Elevators (2.4.6)" available at http://www.elevatorbob.com/U19.html, 2002-2010, 14 pgs.

* cited by examiner

TIE-DOWN DEVICE FOR COMPENSATION SHEAVE, COMPENSATION SHEAVE AND ELEVATOR

FOREIGN PRIORITY

This application claims priority to Chinese Patent Application No. 201610683000.5, filed Aug. 18, 2016, and all the benefits accruing therefrom under 35 U.S.C. § 119, the contents of which in its entirety are herein incorporated by reference.

FIELD OF INVENTION

The present invention relates to the field of elevators, more particularly to a tensioning device for a compensating sheave, and also to a compensating sheave provided with the tensioning device and an elevator configured with the compensating sheave.

BACKGROUND OF THE INVENTION

Elevators are passenger tools used frequently in daily life. In order to ensure safety of elevator applications, at present, according to the latest national technics regulations, when a rated speed of an elevator is less than 3.5 m/s, a compensating chain must be used; when the rated speed of the elevator is equal to or greater than 3.5 m/s, a compensating rope must be used, and the compensating rope must have a guide, i.e., a rope sheave; and when the rated speed of the elevator is equal to or greater than 4 m/s, an anti-rebound device must be additionally provided, that is, a tensioning device. When the elevator is in an emergency stop state, a cabin side or a counterweight side will continue to rush upward due to inertia, at this moment, the anti-rebound device may pull the compensating sheave to thereby pull an elevator cabin or a counterweight by the compensating rope so as to prevent dangerous situations such as loosening or bracketing of a steel wire rope and the like resulting from upward jumping due to the inertia. In order to improve this current situation, an idea is proposed by an expert in the art that a hydraulic device is used as the tensioning device to overcome the above-mentioned problems. However, a number of problems need to be considered before applying the idea to a practical occasion, for example, a problem of how to prevent oil leakage in an oil hydraulic circuit while a normal operation of the tensioning device is not influenced, and as another example, a problem of how to reduce time and cost for installation, transportation and later maintenance, and the like.

SUMMARY OF THE INVENTION

An object of the present invention is to provide a tensioning device for a compensating sheave which is more efficient and capable of maintaining its own structural reliability when installation, maintenance and replacement are required.

An object of the present invention is further to provide a compensating sheave having the tensioning device for the compensating sheave according to the present invention for ease of maintenance.

An object of the present invention is still to provide an elevator which has the compensating sheave according to the invention and is very safe and reliable.

In order to achieve the above or other objects, the present invention provides the following technical solution.

According to one aspect of the present invention, there is provided a tensioning device for a compensating sheave. The compensating sheave is provided with a housing. The tensioning device comprises:

a first snap-fit member rotatably fixed on the housing and comprising a first end always subjected to a downward force and a second end configured with a cam profile;

a second snap-fit member disposed adjacent to the first snap-fit member; and a trigger mechanism comprising a resilient assembly for transmitting an acceleration of the compensating sheave and a limiting assembly for triggering the first snap-fit member, wherein the limiting assembly is provided with a limiting member with an arched profile, wherein the tensioning device has a first state in which the limiting member abuts against the second end of the first snap-fit member so that a certain clearance is kept between the first end of the first snap-fit member and the second snap-fit member and a second state in which the limiting assembly is moved downward so that the first end of the first snap-fit member is rotated downward until the first end is snap-fitted with the second snap-fit member.

According to yet another aspect of the present invention, a compensating sheave is provided which is provided with the tensioning device for the compensating sheave as described above.

According to still another aspect of the present invention, there is further provided an elevator which is configured with the compensating sheave as described above.

DESCRIPTION OF THE DRAWINGS

Other advantages and details of the present invention will be explained by means of embodiments shown in the accompanying drawings, in which.

LIST OF COMPONENTS AND REFERENCE NUMBERS

Figure 1:
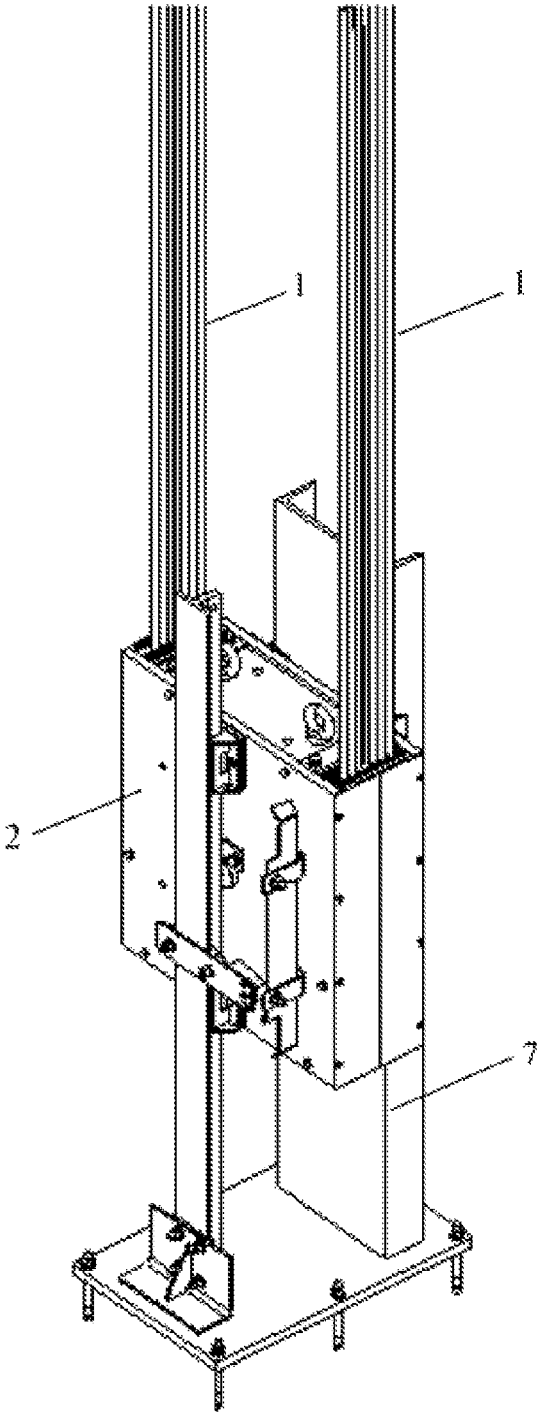
FIG. 1 is a structural schematic view of a tensioning device for a compensating sheave according to an embodiment of the present invention.

| | |
|---|---|
| 1 | compensating rope |
| 2 | housing |
| 3 | first snap-fit member |
| 31 | first end |
| 32 | second end |
| 33 | first resilient element |
| 4 | limiting member |
| 5 | second resilient element |
| 6 | weight |
| 7 | channel steel |
| 8 | second snap-fit member |
| 9 | nut |

-continued

| | |
|---|---|
| 10 | stem |
| 11 | base |

DETAILED DESCRIPTION OF THE INVENTION

Hereinafter, specific embodiments of the invention will be described in detail in conjunction with the accompanying drawings. First, it should be stated that positional terms such as "upper", "lower", "right", "front", "rear", "inner side", "outer side", "top", "bottom" and the like mentioned or possibly mentioned in this specification are defined with respect to configurations shown in the drawings, and they are relative concepts, and therefore may be possibly changed correspondingly based on their different locations and different use states. Accordingly, these or other positional terms should not be explained as limiting terms.

Figure 2:
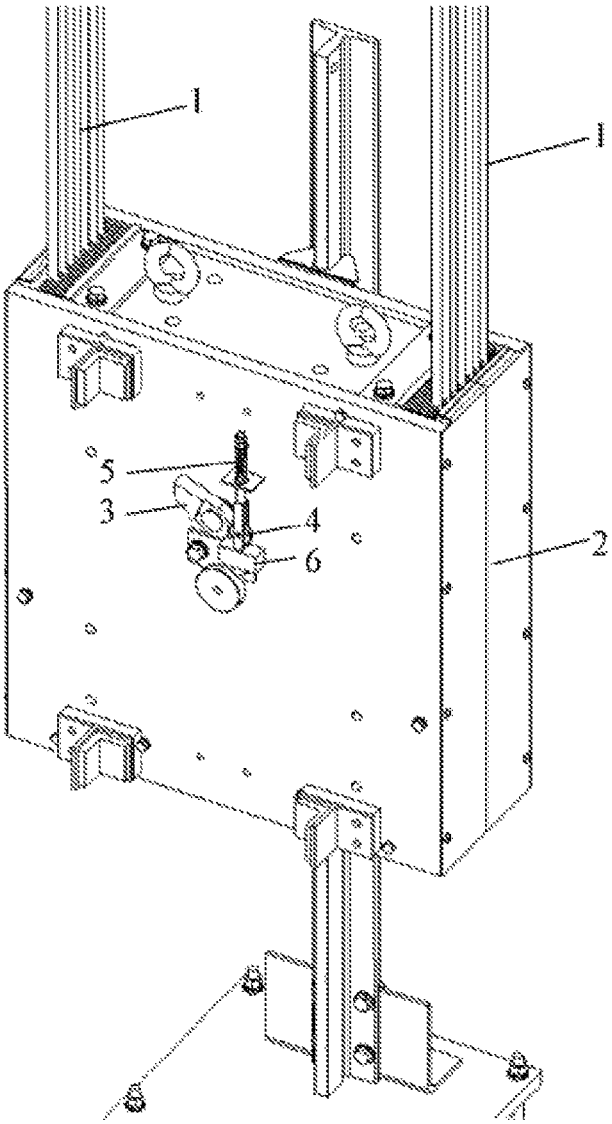
FIG. 2 is a structural schematic view of a housing of the compensating sheave of FIG. 1.

As shown in FIG. 1, in general, there is schematically shown a structure of one embodiment of a tensioning device for a compensating sheave according to the present invention. As can be seen from embodiments shown in FIGS. 1 and 2, one end of the compensating sheave is connected to an elevator cabin by a compensating rope 1 and the other end is connected to a counterweight by the compensating rope 1, the compensating sheave is usually located at a pit of an elevator shaft and is provided with a housing 2 for receiving the compensating sheave therein. Herein, the tensioning device comprises components such as a first snap-fit member 3, a second snap-fit member 8 and a trigger mechanism and the like. It should be illustrated that, in order to more clearly show a connection relationship between various components, the elevator cabin and the counterweight matching therewith are not depicted in the drawings.

Figure 3:
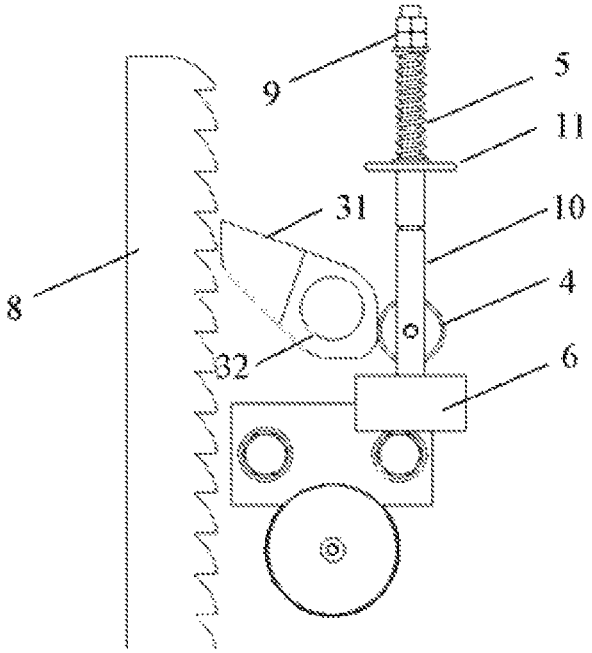
FIG. 3 is a structural schematic view of the tensioning device, in a first state, for the compensating sheave of FIG. 1.
Figure 4:
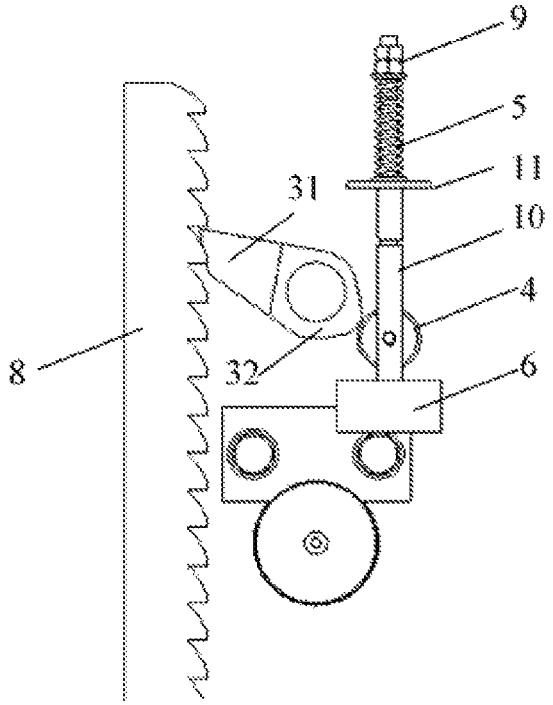
FIG. 4 is a structural schematic view of the tensioning device, in a second state, for the compensating sheave of FIG. 3.
Figure 5:
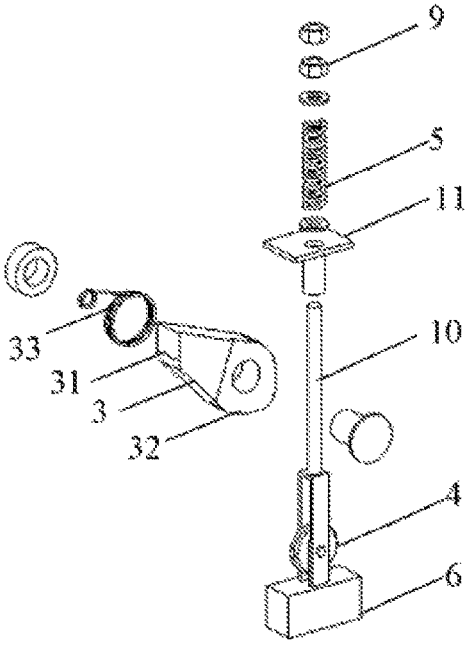
FIG. 5 is an exploded schematic view of the tensioning device for the compensating sheave of FIG. 3.

Simultaneously referring to FIGS. 3 to 5, the basic configurations of the above-described components according to the present invention and relative position relationships, coordinated movements and connection relationships between the above-described components and other peripheral components can be more completely understood in conjunction with the accompanying drawings.

Figure 6:
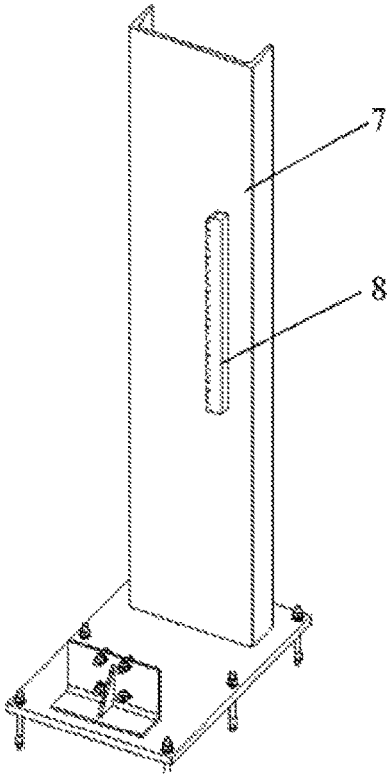
FIG. 6 is a structural schematic view of a channel steel of FIG. 1.

In embodiments shown in FIGS. 1-5, the first snap-fit member 3 is rotatably fixed on the housing 2 by a rotary shaft and comprises, for example, a first end 31 which may be configured as a tip and a second end 32 which is configured with a cam profile, wherein the first snap-fit member 3 may be configured in the form of a pawl, which, due to its own gravity and for example under the effect of a first resilient element 33 which is configured as a spring wire, is always subjected to a downward force rotating counter-clockwise as shown. As can be clearly seen in the drawings, a second snap-fit member 8 is disposed in the vicinity of the first end 31 of the first snap-fit member 3, the second snap-fit member 8 may be designed as a rack and is fixed to an inner side of the channel steel 7 which in turn may be fixed at the pit of the elevator shaft as a guide rail for the compensating sheave, and the second snap-fit member 8 may preferably be fixed to the channel steel 7 by means of welding, as shown in FIG. 6.

Next, the trigger mechanism in the above-described embodiments will be described in detail, and it is indicated that in the case where the elevator is accelerated or decelerated suddenly, the design of the trigger mechanism may allow engagement or disengagement between the first snap-fit member 3 and the second snap-fit member 8 so as to advantageously achieve the objects of the present invention.

In the embodiments as shown in FIGS. 1-5, the trigger mechanism comprises an resilient assembly for transmitting an acceleration of the compensating sheave. Here, the resilient assembly comprises a second resilient element 5 and base 11 thereof, wherein the base 11 is fixed on the housing 2, an elastic force of an upper end of the second resilient element 5 may be adjusted by a nut 9 to accommodate different magnitudes of accelerations and a lower end of the second resilient element 5 may be connected with a stem 10. Preferably, the second resilient element 5 may take the form of a compression spring or the like. In addition, the trigger mechanism further comprises a limiting assembly for triggering the first snap-fit member 3, wherein the limiting assembly is provided with a limiting member 4 with an arched profile, the stem 10 and a weight 6, the stem 10 passes through the second resilient element 5 and is fixed to the base 11, and the limiting member 4 abuts against a side of the second end 32 of the first snap-fit member 3 under the effect of the elastic force of the second resilient element 5, the weight 6 is disposed on the stem 10 and is located below the limiting member 4 for providing a required acceleration during disengagement.

In the given embodiments, the tensioning device for the compensating sheave rotates the first snap-fit member 3 between first and second states through interaction between the resilient assembly and the limiting assembly. It may be contemplated that, when the elevator travels normally, i.e. in the first state in the case of the normal operation as shown in FIG. 3, the limiting assembly rests at the uppermost end of the travel under the effect of the elastic force of the second resilient element 5, the limiting member 4 of which abuts against the side of the second end 32 of the first snap-fit member 3, at this time a balance between a rotational force applied by the first resilient element 33 to the first snap-fit member 3 and a support force applied by the limiting member 4 to the first snap-fit member 3 is achieved, and a balance between the elastic force of the second resilient element 5 and a force to which the second end 32 of the first snap-fit member 3 is subjected is achieved, so that a certain clearance is kept between the first end 31 of the first snap-fit member 3 and the second snap-fit member 8. Preferably, the clearance is not greater than 4 mm. When the elevator is in an emergency stop state, that is, in the second state as shown in FIG. 4, the cabin or counterweight is jumped upward due to inertia and an upward acceleration is brought to the compensating sheave, and the trigger mechanism thereby moves upward rapidly, while the weight 6 in the limiting assembly is kept at an original position due to inertia. At this time, the second resilient element 5 in the resilient assembly needs to be compressed to provide the same acceleration force as the compensating sheave and the limiting assembly, and the limiting assembly is moved downward under the acceleration force, so that the first snap-fit member 3 is cleared of confinement to the limiting member 4. The first end 31 of the first snap-fit member 3 automatically rotates downward since there is no restriction from the limiting member (it is to be stated that the feature "the first snap-fit member 3 is cleared of confinement to the limiting member 4" herein may comprise a case where the first snap-fit member 3 is not in contact with the limiting member 4, or may further comprise a case where the first snap-fit member 3 remains in contact with the limiting member 4, in such a case although the first snap-fit member 3 and the limiting member 4 are in contact with each other, a force applied by the limiting member 4 to the first end 31 of the first snap-fit member 3 is less than a force applied by the first resilient element 33, so that the first snap-fit member 3 is no longer influenced by the limiting member 4) so that the first end 31 of the first snap-fit member 3 is snap-fitted with the second snap-fit member 8, thereby clamping the second snap-fit member 8 to prevent the compensating sheave to continue to move upward, so as to achieve the purpose of tensioning. After the compensating sheave is kept stable, the limiting member 4 is returned to the uppermost end of the travel under the effect of the elastic force of the second resilient element 5, the limiting member 4 disengages the first snap-fit member 3 from the second snap-fit member 8 through a chamfer, designed in an arch shape, on the first snap-fit member 3, and rotates back to an initial position, leading to the trigger mechanism automatically returns to the first state.

It is to be specifically stated that a longitudinal direction of the second resilient element 5 and a center of the limiting member 4 may advantageously be arranged in the same vertical direction as shown in FIG. 3. In order to enable the limiting assembly to be rapidly brought back to the original position, a circular chamfer may also be designed on the side of the second end 32 of the first snap-fit member 3 so that the first snap-fit member 3 will be more easily adjusted back to the original work position.

It may be understood that the size, the position and the number of a snap-fit combination of the first snap-fit member 3 and the second snap-fit member 8 in the tensioning device for the compensating sheave described above can be adjusted based on different conditions. For example, in a case where an elevator load is relatively large, the tensioning device may also comprise a further combination of a first snap-fit member and a trigger mechanism, which, for the space-saving purpose, may share a second snap-fit member with the first snap-fit member and the trigger mechanism in the aforementioned embodiments, thereby better preventing play of the high-power elevator during an emergency stop.

The present invention also provides a compensating sheave provided with the tensioning device for the compensating sheave described above. The present invention also provides an elevator to which the compensating sheave described above is applied, and thus time for maintenance or replacement of parts can be greatly shortened during inspection of the elevator, labor costs, material costs and time costs are reduced, and occurrence of situations such as a user's boredom emotion and the like during waiting is also avoided.

In conclusion, the tensioning device for the compensating sheave of the present invention adopts a completely mechanical structure, which is not only simple in structure, compact in arrangement, but also has many advantages of a low cost and being environmental friendly, and the like. In addition, it is emphasized that the tensioning device and compensating sheave may also be assembled together and shipped as a complete set of assemblies without re-commissioning at an elevator installation site, thus greatly saving time for installation and transportation and facilitating later maintenance. In view of many advantages that the tensioning device for the compensating sheave has in terms of an overall construction and detail structures and the like, it is very suitable for large-scale production and application as a universal component mounted and disposed on an elevator.

The above examples mainly illustrate the tensioning device for the compensating sheave, the compensating sheave provided with the tensioning device, and the elevator configured with the compensating sheave according to the present invention. Although only some embodiments of the present invention are described, it will be understood by those of ordinary skill in the art that the present invention may be embodied in many other forms without departing from the spirit and scope thereof. For example, the limiting member may be configured as a scroll wheel or other components having an arched section, and furthermore, the scroll wheel may be designed to be rotatable or non-rotatable about a center. Accordingly, the illustrated examples and embodiments are to be considered as illustrative and not restrictive, and that the present invention may encompass various modifications and replacements without departing from the spirit and scope of the present invention as defined by the appended claims.

What is claimed is:

1. A tensioning device for a compensating sheave, the compensating sheave being provided with a housing, characterized in that, the tensioning device comprises:

a first snap-fit member rotatably fixed on the housing and comprising a first end which is always subjected to a downward force and a second end configured with a cam profile;

a second snap-fit member disposed adjacent to the first snap-fit member; and a trigger mechanism comprising a resilient assembly for transmitting an acceleration of the compensating sheave and a limiting assembly for triggering the first snap-fit member, wherein the limiting assembly is provided with a limiting member having an arched profile, wherein the tensioning device has a first state in which the arched profile of the limiting member abuts against the cam profile of the second end of the first snap-fit member so that a certain clearance is kept between the first end of the first snap-fit member and the second snap-fit member and a second state in which the limiting assembly is moved downward so that the first end of the first snap-fit member is rotated downward until the first end is snap-fitted with the second snap-fit member.

2. The tensioning device according to claim 1, characterized in that, the resilient assembly comprises a second resilient element and a base thereof, and the base is fixed on the housing.

3. The tensioning device according to claim 2, characterized in that, the limiting assembly further comprises: a stem passing through the second resilient element and fixed to the base; and a weight disposed on the stem and located below the limiting member.

4. The tensioning device according to claim 2, characterized in that, the second resilient element is a compression spring.

5. The tensioning device according to claim 2, characterized in that, a longitudinal direction of the second resilient element and a center of the limiting member are arranged in the same vertical direction.

6. The tensioning device according to claim 2, characterized in that, the second resilient element is provided with a nut for adjusting an elastic force.

7. The tensioning device according to claim 1, characterized in that, the first snap-fit member is a pawl.

8. The tensioning device according to claim 1, characterized in that, the second end of the first snap-fit member has a circular chamfer.

9. The tensioning device according to claim 1, characterized in that, the clearance is not greater than 4 mm.

10. The tensioning device according to claim 1, characterized in that, the limiting member is configured as a scroll wheel.

11. The tensioning device according to claim 10, characterized in that, the scroll wheel is configured to be rotatable or non-rotatable about a center.

12. The tensioning device according to claim 1, characterized in that, the first end of the first snap-fit member is subjected to a downward force of the first resilient element.

13. The tensioning device according to claim 12, characterized in that, the first resilient element is a spring wire.

14. The tensioning device according to claim 1, characterized in that, the tensioning device further comprises an additional first snap-fit member and a trigger mechanism.

15. The tensioning device according to claim 1, characterized in that, the first end of the first snap-fit member is configured as a tip.

16. The tensioning device according to claim 1, characterized in that, the second snap-fit member is configured as a rack.

17. The tensioning device according to claim 1, characterized in that, the second snap-fit member is fixed at an elevator pit.

18. The tensioning device according to claim 17, characterized in that, the second snap-fit member is fixed on a channel steel at the elevator pit by means of welding.

19. A compensating sheave, characterized in that, the compensating sheave is provided with the tensioning device according to claim 1.

20. An elevator, characterized in that, the elevator is configured with the compensating sheave according to claim 19.

* * * * *